US005571279A

United States Patent [19]

Chiang

[11] Patent Number: 5,571,279

[45] Date of Patent: Nov. 5, 1996

[54] TORCH WITH BELLOWED INTERMEDIATE FLEXIBLE HOSE MEMBER

[76] Inventor: Hanh Chiang, No. 162, Chung-Cheng S. Rd., Hsin-Ying Hsiang, Tainan Hsien, Taiwan

[21] Appl. No.: 581,174

[22] Filed: Dec. 29, 1995

[51] Int. Cl.[6] ..... F21L 7/00

[52] U.S. Cl. ..... 362/198; 362/157; 362/205

[58] Field of Search ..... 362/157, 189, 362/198, 205, 418

[56] References Cited

U.S. PATENT DOCUMENTS

| | | | |
|---|---|---|---|
| 3,103,723 | 9/1963 | Becker | 362/198 X |
| 4,443,831 | 4/1984 | Godfrey et al. | 362/198 X |
| 4,733,337 | 3/1988 | Bieberstein | 362/202 X |

*Primary Examiner*—Stephen F. Husar
*Attorney, Agent, or Firm*—Foley & Lardner

[57] ABSTRACT

A torch includes a head member, a tail member, and a bellowed intermediate flexible hose member connected threadedly to the head and tail members. The head member includes a bulb unit disposed therein, and an on-off switch which is mounted on the head member and which is capable of energizing the bulb unit upon actuation. The tail member includes a cell unit for supplying power to the bulb unit. One of the head member and the tail member has an internally threaded end section, while the other of the head member and the tail member has an externally threaded end section. The hose member has an externally threaded end section, an internally threaded end section, and two conductive contact sets respectively located in the end sections of the hose member in such a manner that one of the conductive contact sets is in electrical contact with the bulb unit while the other one of the conductive contact sets is in electrical contact with terminals of the cell unit. The tail and head members can be detached easily from the hose member so as to interconnect the head and tail members, thus forming an ordinary torch, wherein the bulb unit of the head member and the terminals of the cell unit in the tail member are coupled together electrically.

1 Claim, 6 Drawing Sheets

TORCH WITH BELLOWED INTERMEDIATE FLEXIBLE HOSE MEMBER

BACKGROUND OF THE INVENTION

1. Field of the Invention

The invention relates to a torch, more particularly to a torch with a bellowed intermediate flexible hose member.

2. Description of the Related Art

Referring to FIGS. 1 and 2, a conventional torch 10 is shown to include a head member 12, a tail member 13, and a bellowed intermediate flexible hose member 11. As illustrated, the flexible hose member 11 includes a hose body 111, first and second wires 15 disposed within the hose body 111, and two conductive plug sets 161 respectively provided on two opposite end portions of the wires 15. Each of the head and tail members 12, 13 has two socket sets 171 connected electrically to a corresponding one of a bulb unit on the head member 12 and a cell unit in the tail member 13 by means of wires 17. In assembly, the plug sets 161 of the hose member 11 are inserted into the socket sets 171 of the head and tail members 12, 13. Then, the hose member 11 is attached to both the head and tail members 12, 13 by rivets 19 so as to fix the head and tail members 12, 13 on the end portions of the hose member 11.

Some of the drawbacks of the aforesaid torch are as follows:

(I) The head and tail members 12, 13 cannot be easily removed from the hose member 11 so that in case of disengagement of the plug and socket sets 161, 171 or breakage of wires 17, the torch becomes useless.

(II) After removal from the hose member 11, the head and tail members 12, 13 cannot be connected to each other for conversion into an ordinary torch, thereby limiting the utility thereof.

SUMMARY OF THE INVENTION

An object of this invention is to provide a torch which includes a head member, a tail member and a flexible hose member that are removably joined to one another.

Another object of this invention is to provide a torch which can be converted into an ordinary torch.

Accordingly, a torch of this invention includes a head member, a tail member, and a bellowed intermediate flexible hose member connected threadedly to the head and tail members. The head member includes a bulb unit disposed therein, and an on-off switch which is mounted on the head member and which is capable of energizing the bulb unit upon actuation. The tail member includes a cell unit for supplying power to the bulb unit. One of the head member and the tail member has an internally threaded end section, while the other of the head member and the tail member has an externally threaded end section. The hose member has an externally threaded end section, an internally threaded end section, and two conductive contact sets respectively located in the end sections of the hose member in such a manner that one of the conductive contact sets is in electrical contact with the bulb unit while the other one of the conductive contact sets is in electrical contact with the terminals of the cell unit.

When desired, the tail and head members can be detached easily from the end sections of the hose member so as to interconnect the head and tail members by engagement of the internally threaded end section and the externally threaded end section of the head and tail members, in such a manner that the bulb unit of the head member and the terminals of the cell unit in the tail member are coupled together electrically, thereby forming an ordinary torch.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
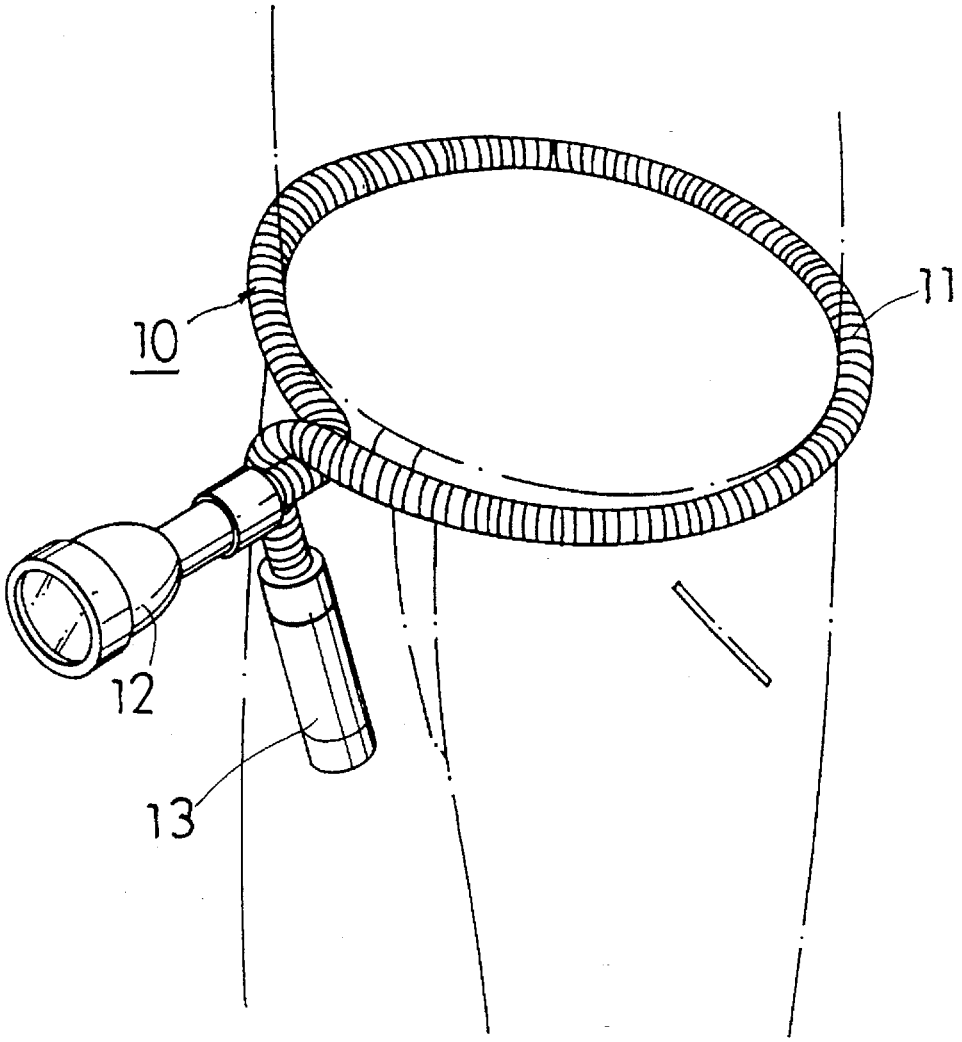
FIG. 1 PRIOR ART
FIG. 1 illustrates how a conventional torch is wrapped around a user's waist.
Figure 2:
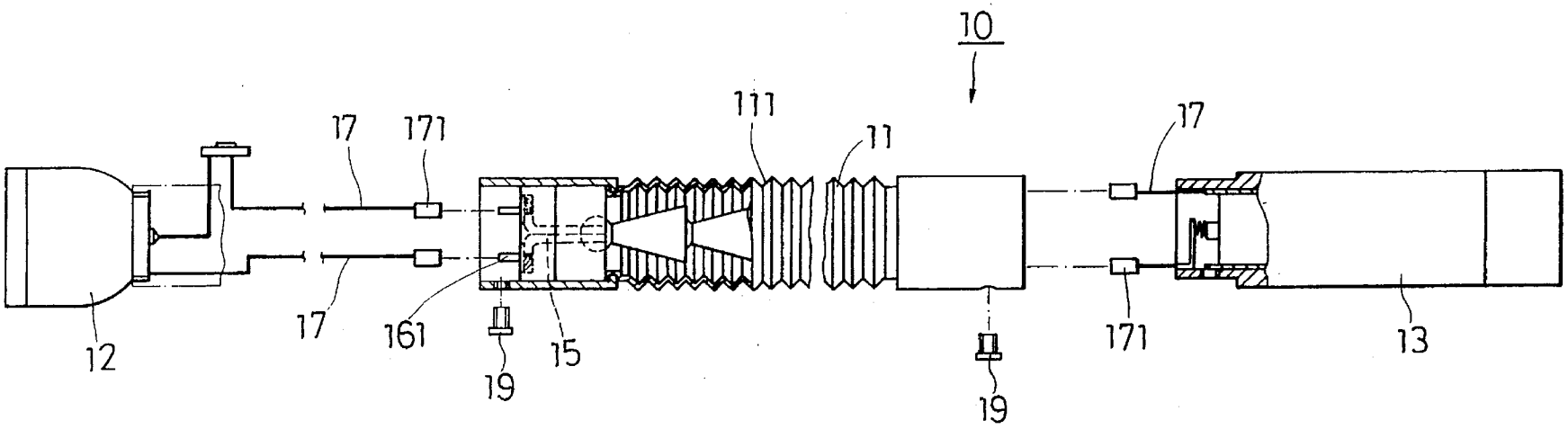
FIG. 2 PRIOR ART
FIG. 2 illustrates the interior of the conventional torch shown in FIG. 1.
Figure 3:
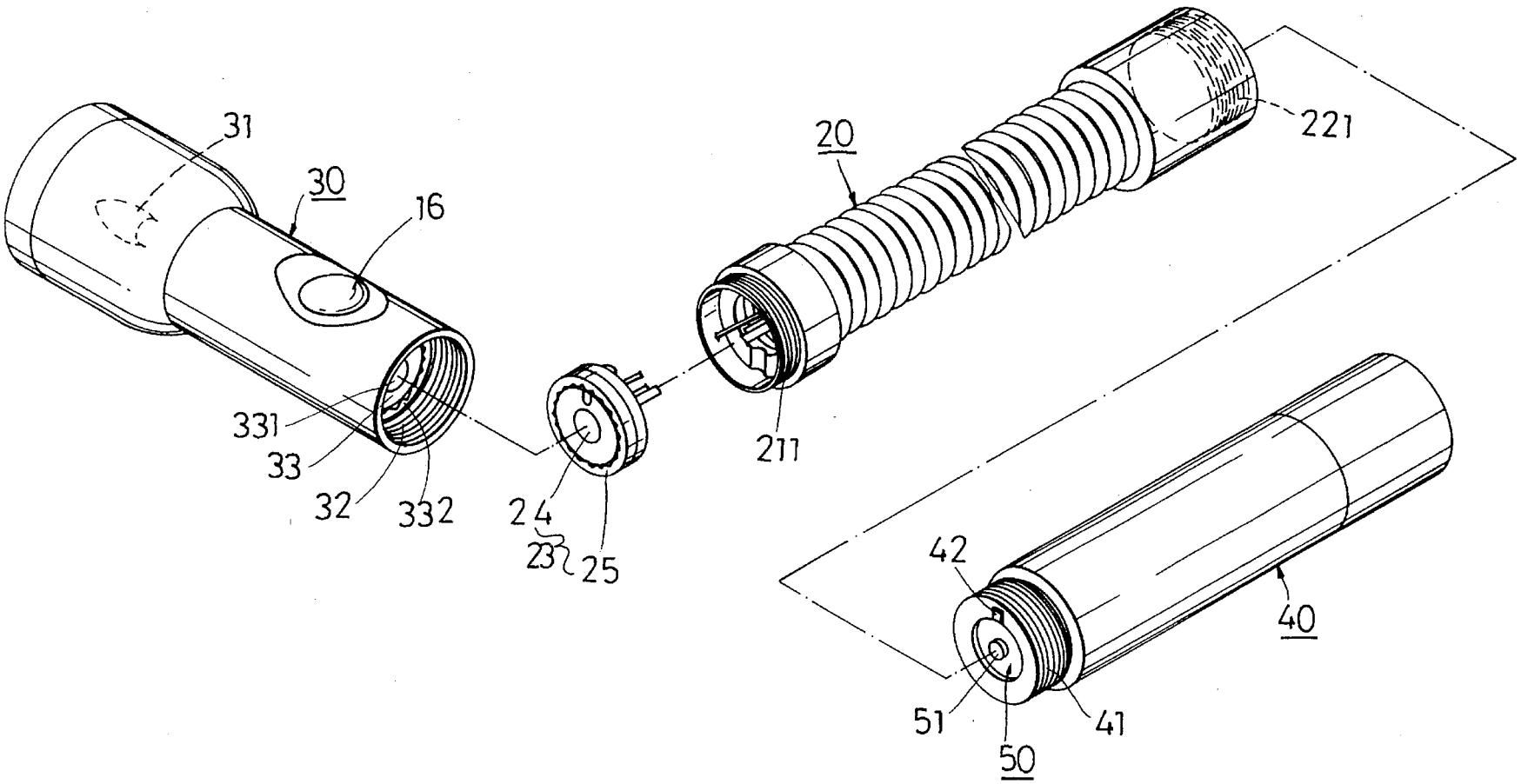
FIG. 3 is a partially exploded view of the preferred embodiment of a torch of this invention.
Figure 4:
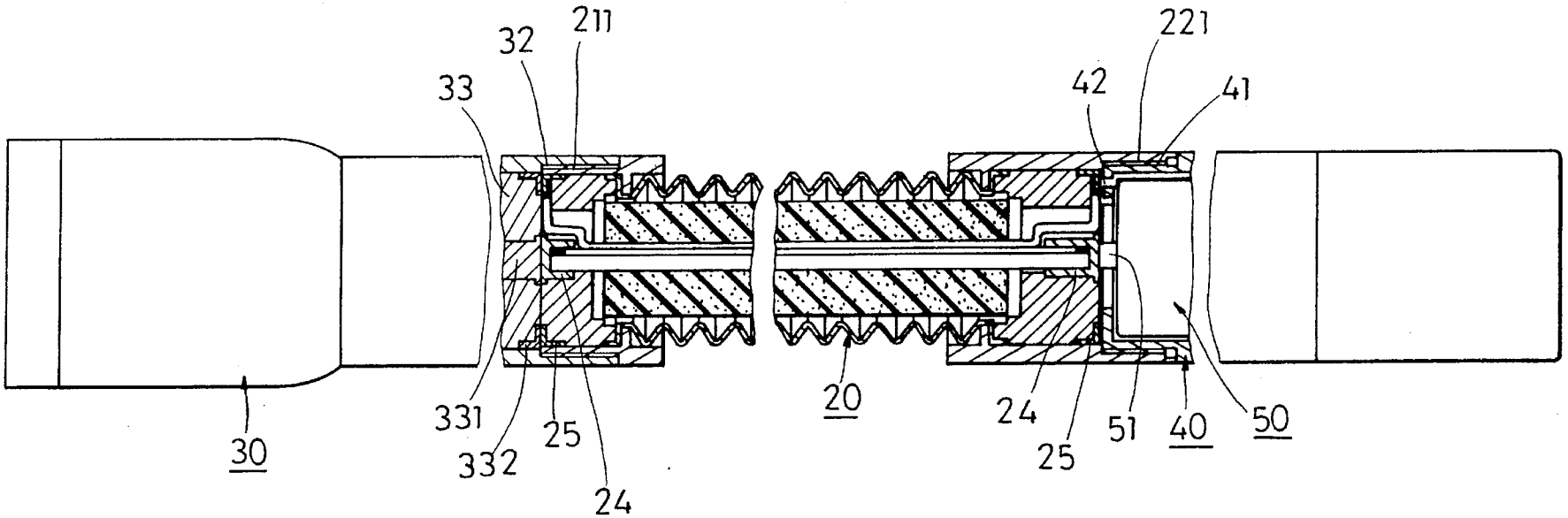
FIG. 4 is a partially sectioned view of the preferred embodiment of this invention.

Referring to FIGS. 3 and 4, the preferred embodiment of a torch of this invention includes a head member 30, a tail member 40, and a bellowed intermediate flexible hose member 20.

As illustrated, the head member 30 includes a bulb unit 31 disposed therein, and an on-off switch 16 which is mounted on the head member 30 and which can energize the bulb unit 31 upon actuation. The head member 30 has an internally threaded end section 32 in which an inward flange 33 is formed so as to prevent disengagement of the bulb unit 31 from the head member 30. The tail member 40 includes a cell unit 50 for supplying power to the bulb unit 31 and has an externally threaded end section 41. The hose member 20 has an externally threaded end section 211, an internally threaded end section 221, and two conductive contact sets 23 each of which consists of two contacts 24, 25 (only one set is shown in FIG. 3). The contact sets 23 are respectively located at the end sections 211, 221 of the hose member 20. After assembly, one of the conductive contact sets 23 is in electrical contact with two terminals 331, 332 of the bulb unit 31 while the other one of the conductive contact sets 23 is in electrical contact with terminals 51, 42 of the cell unit 50.

Figure 7:
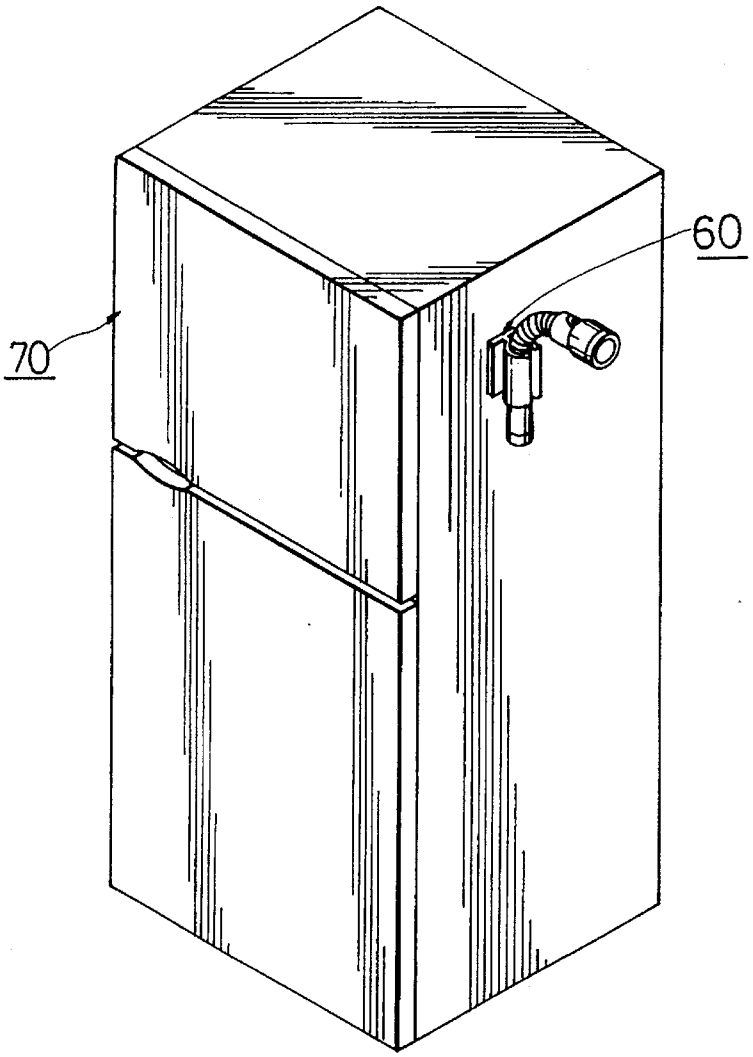
FIG. 7 illustrates how the torch of this invention is mounted on a refrigerator with use of the mounting unit shown in FIG. 6.
Figure 6:
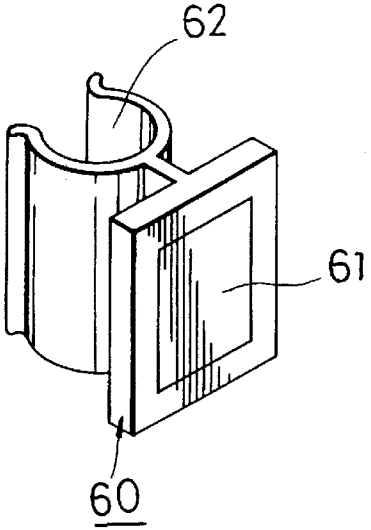
FIG. 6 illustrates a mounting unit for holding the torch of this invention.

Referring to FIGS. 6 and 7, the torch of this invention can be mounted in a holding clamp 62 of a mounting unit 60 which includes a base 61 that is attached adhesively on a wall surface of a refrigerator 70.

Figure 5:
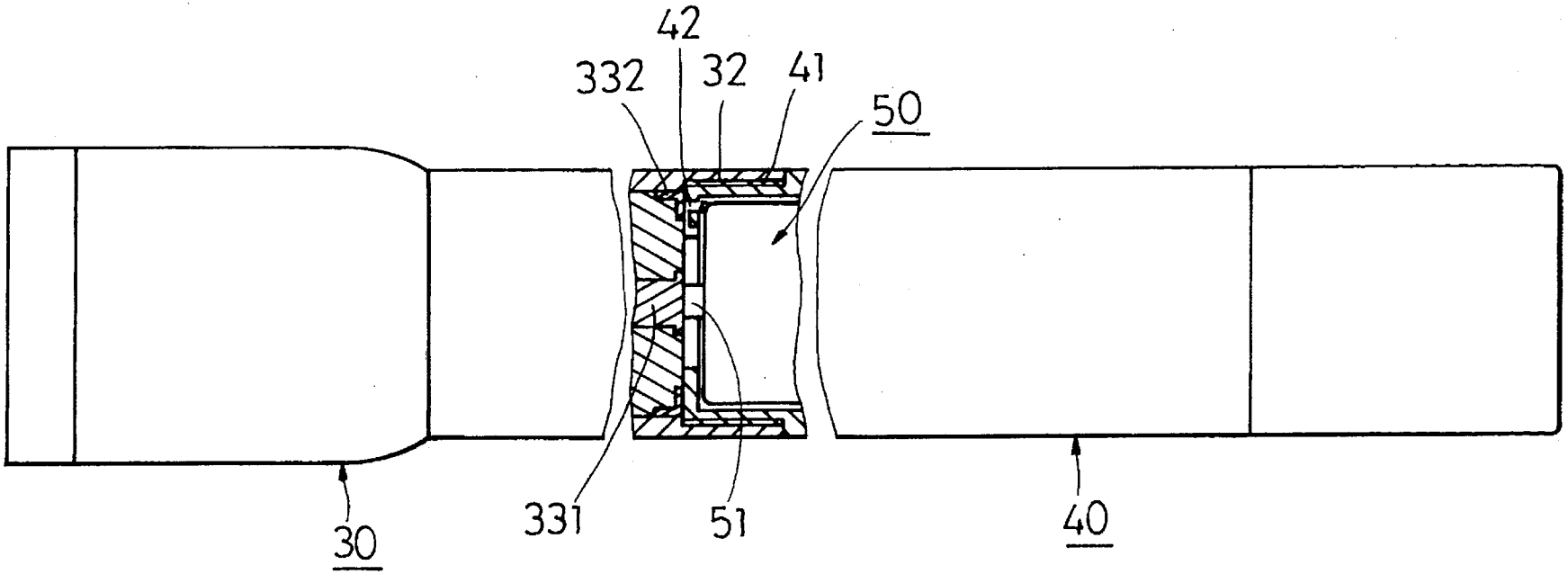
FIG. 5 shows how the head and tail members of the preferred embodiment are interconnected threadedly so as to form an ordinary torch.

As shown in FIG. 5, the tail and head members 30, 40 can be detached easily from the end sections of the hose member 20 (see FIG. 3) so as to interconnect the head and tail members 30, 40 by engagement of the internally threaded end section 32 and the externally threaded end section 41 of the head and tail members 30, 40. In this case, two terminals 331, 332 in the bulb unit 31 of the head member 30 and the terminals 42, 51 of the cell unit 50 in the tail member 40 are coupled together electrically, thereby forming an ordinary torch.

With this invention thus explained it is obvious to those skilled in the art that various modifications and variations can be made without departing from the spirit and scope of this invention. It is therefore intended that this invention be limited only as in the appended claims.

I claim:

1. A torch comprising:

a head member including a bulb unit disposed therein, and an on-off switch which is mounted on said head member and which is capable of energizing said bulb unit upon actuation;

a tail member including a cell unit for supplying power to said bulb unit, one of said head member and said tail member having an internally threaded end section, the other of said head member and said tail member having an externally threaded end section; and a bellowed intermediate flexible hose member having an internally threaded end section, an externally threaded end section, and two conductive contact sets respectively located in said end sections of said hose unit, said hose member being connected threadedly to said head and tail members in such a manner that one of said conductive contact sets is in electrical contact with said bulb unit while the other one of said conductive contact sets is in electrical contact with terminals of said cell unit, said tail and head members being detachable from said end sections of said hose member so as to interconnect said head and tail members by engagement of the internally threaded end section and the externally threaded end section of said head and tail members, thereby coupling said bulb unit and said terminals of said cell unit electrically.

* * * * *